US005821844A

United States Patent [19]

Tominaga et al.

[11] Patent Number: 5,821,844

[45] Date of Patent: Oct. 13, 1998

[54] D.C. REACTOR

[75] Inventors: Ryuichirou Tominaga; Noriaki Iwabuchi; Michihiko Zenke, all of Kitakyushu, Japan

[73] Assignee: Kabushiki Kaisha Yaskawa Denki, Fukuoka, Japan

[21] Appl. No.: 693,204

[22] PCT Filed: Dec. 7, 1995

[86] PCT No.: PCT/JP95/02508

§ 371 Date: Aug. 5, 1996

§ 102(e) Date: Aug. 5, 1996

[87] PCT Pub. No.: WO96/18198

PCT Pub. Date: Jun. 13, 1996

[30] Foreign Application Priority Data

| | | | |
|---|---|---|---|
| Dec. 9, 1994 | [JP] | Japan | 6-331520 |
| Mar. 13, 1995 | [JP] | Japan | 7-081692 |
| Nov. 15, 1995 | [JP] | Japan | 7-322270 |

[51] Int. Cl.[6] ..... H01F 17/04; H01F 27/24

[52] U.S. Cl. ..... 336/110; 336/178; 336/212

[58] Field of Search ..... 336/110, 178, 336/165, 160, 212

[56] References Cited

FOREIGN PATENT DOCUMENTS

| | | |
|---|---|---|
| 46-37128 | 11/1971 | Japan . |
| 50-30047 | 3/1975 | Japan . |
| 54-152957 | 10/1979 | Japan . |
| 57-96512 | 6/1982 | Japan . |
| 484405 | 3/1992 | Japan . |

*Primary Examiner*—Thomas J. Kozma
*Attorney, Agent, or Firm*—Jordan and Hamburg

[57] ABSTRACT

A D.C. reactor has a core structure having two opposed cores separated by a magnetic gap, to form a closed magnetic circuit. A coil is wound on one or both of the cores. A pair of permanent magnets for biasing are disposed on the core structure. The bias flux generated by the permanent magnets and the flux generated by the coil to flow in opposite directions. Bypass means for causing the bias flux generated by the permanent magnets to bypass the magnetic gap are provided. In an embodiment the core structure comprises an E-shape core and an I-shaped core, the magnetic gap is defined between a center leg of the E-shaped core and the I-shaped core, the coil is wound on the center leg of the E-shaped core, and each permanent magnet is shaped as a rectangle and disposed on both side surfaces of the center leg of the E-shaped core. The permanent magnet is a sheet-like permanent magnet magnetized so that in a longitudinal direction and a thickness direction two poles are formed and a neutral line of this permanent magnet is brought into conformity with the center line of the magnetic gap and is disposed on adjacent outer side surfaces of the I-shaped core. Since the flux generated by the D.C. reactor does not pass inside the permanent magnets, an eddy current loss decreases, and even when a large current abruptly flows through the coil, the permanent magnet is not demagnetized.

10 Claims, 5 Drawing Sheets

D.C. REACTOR

BACKGROUND OF THE INVENTION

The present invention relates to a D.C. reactor in which flux generated by the D.C. reactor does not pass inside a permanent magnet so that an eddy current loss is decreased, and even when a large current abruptly flows through a coil of the D.C. reactor, the permanent magnet is not demagnetized. The reactors are capable of using low-cost permanent magnets of lower coercive force than the SmCo-system, such as the Nd-Fe-B system. The invention also relates to D.C. reactors capable of decreasing the core cross-sectional area suitable for downsizing, wherein the magnetic flux is decreased inside the core due to mutual cancellation of a bias magnetic flux formed by permanent magnets and a magnetic flux formed by the coil which are in opposite directions.

Conventional, so-called D.C. reactors make use of permanent magnets to provide magnetic biassing. As one such reactor, there is proposed a D.C. reactor employing an E-shaped core and an I-shaped core, wherein the E-shaped core has a center leg on which a coil is wound and which is lower than side legs, and wherein the side legs are bridged by the I-shaped core while permanent magnets provide magnetic bias and are disposed in a magnetic gap between the center leg of E-shaped core and the I-shaped core. Such an arrangement has been disclosed in, for example, Japanese Patent Publication No. Sho 46-37128. However, with this type of D.C. reactor, since the magnets are inserted into the gap, a specific magnetic material must be employed which will exhibit no demagnetization upon application of the magnetic flux formed by the coil. Also, while the inductance of the D.C. reactor becomes greater as the gap is reduced, a reduced gap renders the magnet thinner, impeding fabrication and causing demagnetization to occur more frequently. Accordingly, it should be strictly required that the magnet be thicker as long as there is some possibility of a large current. This may increase the resulting gap, also increasing the cross-sectional area of the core, and necessitating a larger reactor. Another disadvantage encountered with the prior art reactors is that, when high coercive-force magnets such as rare earth magnets are used to eliminate demagnetization, an increased eddy current may take place inside the magnet due to the small inherent resistance thereof.

One improved D.C. reactor is disclosed in Unexamined Japanese Patent Publication No. Sho 50-30047, wherein the permanent magnet of the aforesaid D.C. reactor consists of a plurality of permanent magnets. With this D.C. reactor, however, while the problem concerning the eddy current loss may be solved, the demagnetization problem remains unsolved, thus increasing manufacturing costs due to the assembly of the plurality of permanent magnets.

A further improved D.C. reactor has been disclosed in Unexamined Japanese Patent Publication No. Hei 4-84405. This reactor comes with an energizing coil provided on the center leg of an E-shaped core of an EI-shaped core, a gap defined between respective tip portions of the center leg and both legs of the E-shaped eve and an I-shaped core, magnetically biased permanent magnets which are arranged at respective outer surfaces of the E-shaped core and magnetized along the thickness thereof in such a manner that their opposed portions are of opposed polarity, and a yoke provided on the outer surface of each permanent magnet to be in contact with a corresponding edge of the I-shaped core. With this kind of D.C. reactor, since the magnetic flux formed by the coil does not flow inside the permanent magnets, demagnetization will no longer take place.

However, the reactor suffers from another problem in that the magnetic flux formed by the permanent magnets and the magnetic flux formed by the coil are such that they extend in the same direction on either the right or left side of the E-shaped core while they extend in opposite directions on the other side, thus causing the nearby core in the same direction to be easily saturated.

SUMMARY OF THE INVENTION

Accordingly, an object of the present invention is to provide a D.C. reactor capable of avoiding the disadvantages of the prior art, which can also eliminate demagnetization of permanent magnets, suppress the occurrence of saturation of any magnetic flux inside the core, and reduce the size and manufacturing costs thereof.

According to the present invention, a D.C. reactor includes a core structure having two opposing cores with a magnetic gap being defined therebetween to form a closed magnetic circuit, a coil wound on one or both of the cores of the core structure, and a pair of biassing permanent magnets provided on the core structure, the improvement comprising magnetic flux generation means for causing the bias flux induced by the permanent magnets and the magnetic flux created by the coil to flow in opposite directions, and bypass means for forcing the bias flux created by the permanent magnets to bypass the magnetic gap. Furthermore, the core structure comprises an E-shaped core and an I-shaped core, wherein the magnetic gap is defined between the center leg of the E-shaped core and the I-shaped core, the coil is wound on or around the center leg of the E-shaped core, and the permanent magnets are formed into a rectangular shape and provided at both the sides of the center leg of the E-shaped core. With such an arrangement, the magnetic flux induced by the coil and the magnetic flux formed by the permanent magnets are diverted in the magnetic gap, enabling the D.C. reactor to eliminate demagnetization in the permanent magnets.

In accordance with another aspect of the present invention, the permanent magnets of the improved D.C. reactor mentioned above are each formed of a plate-shaped permanent magnet, magnetized so that each of its longitudinal directions and the direction of thickness form two poles on each side, while a neutral line of this permanent magnet is brought into conformity with a center line of the magnetic gap and is disposed on both the outer surfaces of the core structure. With such an arrangement, since the magnetic flux created by the coil does not pass through the inside of permanent magnet, the permanent magnet will not be demagnetized, while forcing the bias magnetic flux formed by the permanent magnet and the magnetic flux created by the coil to be in opposite directions and thus be cancelled out with the result that the magnetic flux is decreased inside the core, which may enable the core to have a decreased cross-sectional area as compared with a core where no biassing magnets are used.

DETAILED DESCRIPTION OF THE INVENTION

Figure 1:
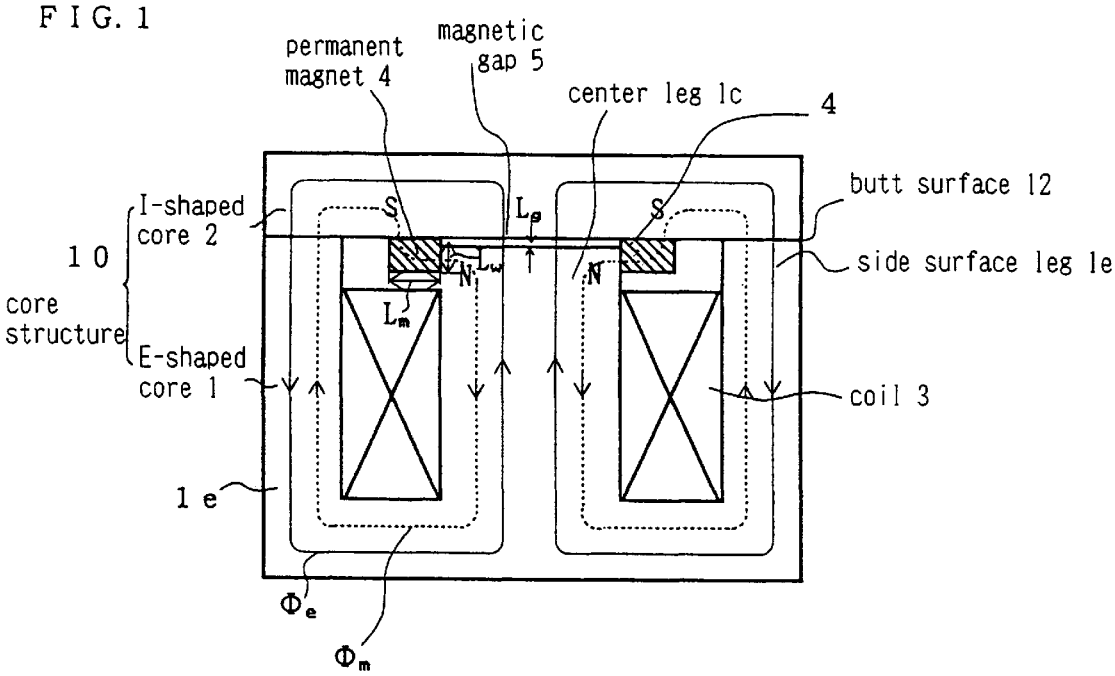
FIG. 1 is a diagram showing a principal cross-sectional view of a D.C. reactor in accordance with a first embodiment of the present invention.

The present invention is described below with reference to the accompanying drawings. FIG. 1 shows a principal cross-sectional view of a D.C. reactor in accordance with a first embodiment of the present invention. An E-shaped core 1, made of a chosen soft magnetic material, and an I-shaped core comprised of a magnetic material are combined on a butt plane 12 to constitute an EI-shaped core structure 10. The reactor shown is similar to the prior art in that a center leg 1*c* of the E-shaped core is shorter than the outer side legs 1*e* thereof defining a magnetic gap 5 therebetween in order to attain a desired value of inductance. Note here that a very thin insulator sheet may be inserted into butt plane 12 for elimination of vibration. Two rectangular permanent magnets 4 having a width determined to provide a predefined biased magnetic flux are arranged on both sides of a certain portion of center leg 1*c* where magnetic gap 5 is formed, in such a manner that these magnets are anisotropically magnetized causing the contacted portions to be of differing polarity from each other. These permanent magnets are specifically disposed so that they are parallel with I-shaped core 2, while allowing their same polarity portions to oppose each other with the center leg 1*c* being interposed therebetween. In this embodiment the N pole sections of the permanent magnets 4 are disposed on opposite sides of center leg 1*c* as shown. The width Lw of each permanent magnet 4 is determined relative to the length Lg of magnetic gap 5 to satisfy Lw>>Lg, thus enabling accomplishment of the desired magnetic biassing effect. The thickness Lm of the permanent magnets 4 is suitably determined by taking into account the field of demagnetization that may occur due to leakage flux of a coil 3. The coil 3 is wound on or around center leg 1*c*, allowing magnetic flux Φe induced by the coil 3 to extend from the center leg 1*c* toward the magnetic gap 5. Hence, the magnetic flux Φe formed by the coil 3 and magnetic flux bias Φm created by the permanent magnets 4 are opposite in directions. Permanent magnet pair 4 and coil 3 constitute a magnetic flux generation means for causing the magnetic flux formed by each of them to flow inside core structure 10 in opposite directions. In this case, the magnetic flux created by permanent magnets 4 in magnetic gap 5 flows inside permanent magnets 4 to bypass magnetic gap 5. Note that coil 3 may alternatively be wound on both side legs 1*e*. Note also that permanent magnets 4 are not exclusively limited to a rectangular shape; they may alternatively be either ring shaped or a rectangularly solid shape having a center opening that is engageable with center leg 1*c*.

The operation is as follows. When coil 3 is magnetically excited or magnetized by a pulsating D.C. current supplied thereto, it creates magnetic flux Φe, which extends from the center leg 1*c* of E-shaped core 1 and penetrates magnetic gap 5 to be diverted or divided at the center of I-shaped core 2 into right and left components, each of which passes through butt plane 12 to return to center leg 1*c* by way of one of the side legs 1*e*, as indicated by the solid line in the drawing. On the other hand, as indicated by the broken lines, the magnetic flux bias Φm created by each permanent magnet 4 extends from center leg 1*c* to penetrate a corresponding one of the side legs 1*e*, and then enters I-shaped core 2 through butt plane 12, and thereafter returns at the center leg 1*c* via permanent magnet 4 while it bypasses magnetic gap 5.

Figure 2:
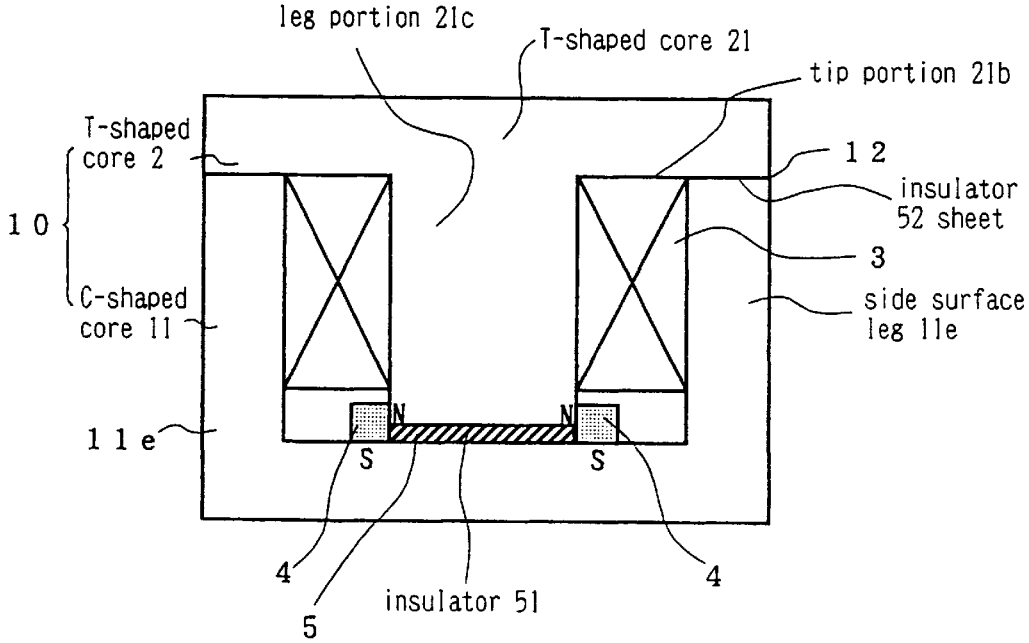
FIG. 2 is a diagram showing a principal cross-sectional view of a D.C. reactor in accordance with a second embodiment of the invention.

FIG. 2 shows a principal cross-sectional view of a second embodiment of the invention. Core structure 110 here is a CT type formed from a combination of a C-shaped core 11 and a T-shaped core 21, rather than the E-shaped core 1 and I-shaped core 2 as in the first embodiment. The T-shaped core 21 has a leg portion 21*c* around which coil 3 is wound. Extremely thin insulator sheets 52 are sandwiched between bottom portions 21*b* of T-shaped core 21 and tip portions of both side legs 11*e* of C-shaped core 11. Likewise, a thin insulator material 51 is interposed between a bottom bar portion of T-shaped core 21 and the central portion of C-shaped core 11. The magnetic gap 5 is defined between leg 21*c* of T-shaped core 21 and the center of C-shaped core 11. The pair of permanent magnets 4 for generating biased magnetic flux are provided on opposite sides of magnetic gap 5 so that their opposed portions have the same polarity. With such an arrangement, the manufacture of coil windings can be easier than that in the first embodiment. The operation is substantially the same as that of the first embodiment, and therefore its explanation will be omitted herein.

Figure 3:
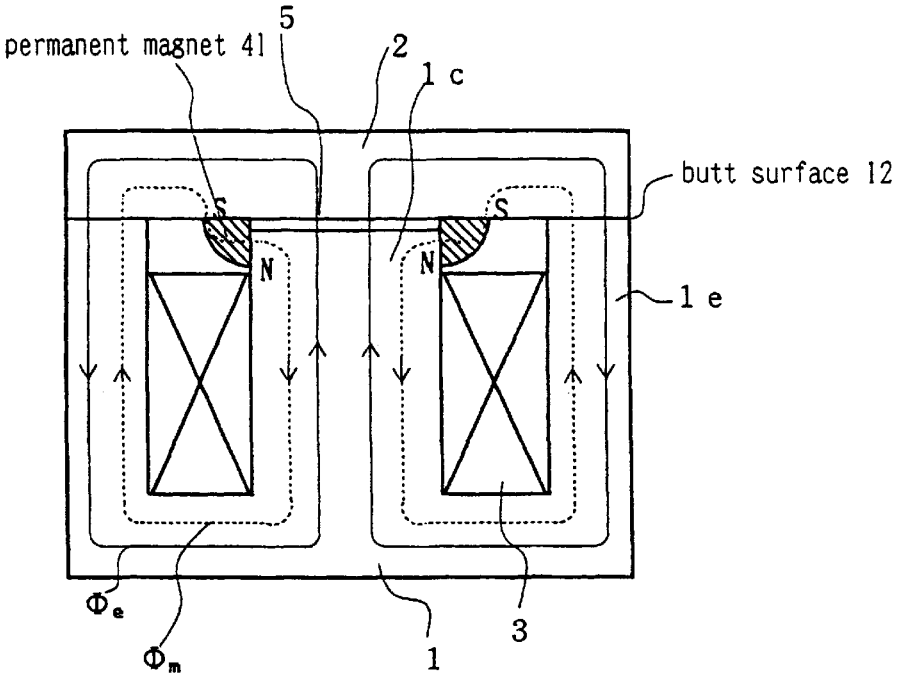
FIG. 3 is a diagram showing a principal cross-sectional view of a D.C. reactor in accordance with a third embodiment of the invention.

FIG. 3 is a diagram showing a principal cross-sectional view of a third embodiment of the invention. This embodiment is arranged to replace permanent magnets 4 of the first and second embodiments with ¼-circular permanent magnets 41. These permanent magnets 41 may alternatively be formed into a right triangular shape.

Figure 4:
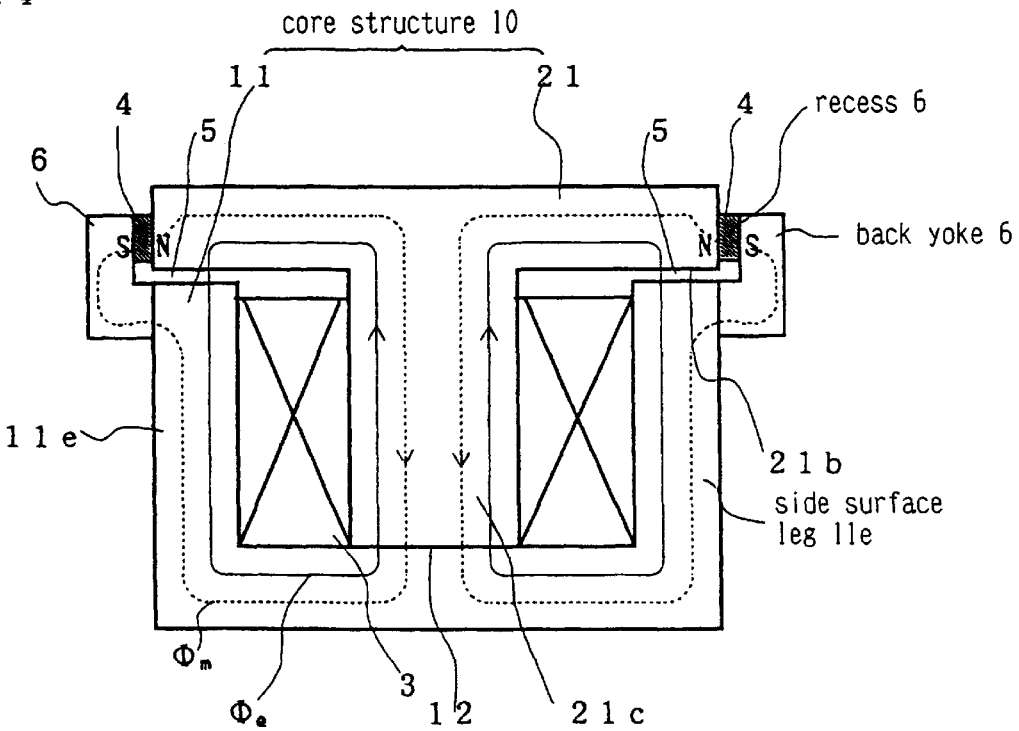
FIG. 4 is a diagram showing a principal cross-sectional view of a D.C. reactor in accordance with a fourth embodiment of the invention.

FIG. 4 is a diagram showing a principal cross-sectional view of a fourth embodiment of the invention. This example is similar to the second embodiment with magnetic gap 5 being modified to be defined between both bottom portions 221*b* of T-shaped core 221 and both ends of side legs 11*e* of C-shaped core 11. The bottom of a center leg 221*c* contacts the C-shaped core 11 to define butt surface 212. Permanent magnets 4 are disposed at both ends of the bar portion of T-shaped core 221 so that the bottom of each magnet 4 is above magnetic gap 5, while the opposed portions thereof have the same polarity. Each permanent magnet 4 has a back surface on which a back yoke 6 is arranged to bridge the outer surface, or the back surface, of each magnet 4 and a corresponding side surface of C-shaped core 11. The back yoke 6 has an L-shape that defines at its upper portion a recess 6*d* having a depth equivalent to the thickness of permanent magnet 4 associated therewith, thereby allowing magnet 4 to be held within recess 6*d* while the lower portion of the L-shaped yoke is secured to the corresponding side surface of C-shaped core 11 coupled therewith. Note that back yokes 6 may be formed integrally with C-shaped core 11 by known die-cut or punch-through fabrication techniques. In this embodiment the magnetic flux Φm formed by each permanent magnet 4 extends from its associative back yoke 6 through permanent magnet 4, and bypasses magnetic gap 5 through which the magnetic flux Φe created by coil 3 passes.

It should be noted that permanent magnets 4 may alternatively be arranged on opposite sides of C-shaped core 11; in this case, magnets 4 are disposed so that the bottom surfaces underlie magnetic gap 5 while back yokes 6 are provided on the bar end surfaces of T-shaped core 221.

Figure 5:
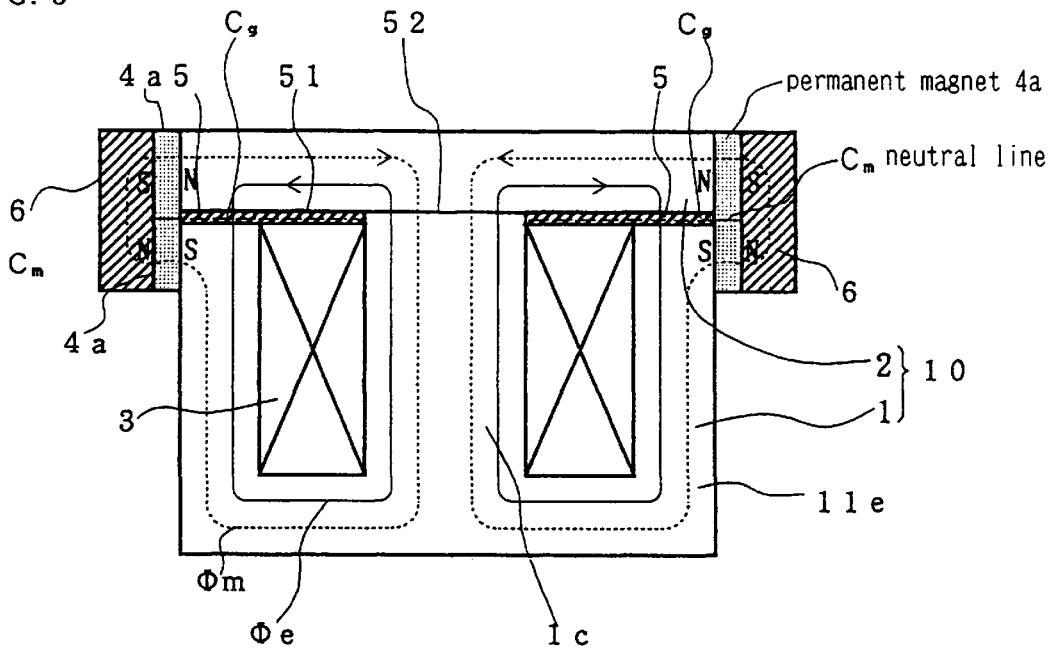
FIG. 5 is a diagram showing a principal cross-sectional view of a D.C. reactor in accordance with a fifth embodiment of the invention.

FIG. 5 is a diagram showing a principal cross-sectional view of a fifth embodiment of the invention. An I-shaped core 2 is provided above an E-shaped core 301 forming an EI-shaped core structure 310. E-shaped core 310 has a center leg 301*c* around which a coil 3 is wound. At the top portions of center leg 301*c* and side legs 301*e,* center leg 301*c* is arranged to be higher than side legs 301*e*. The thin insulator sheet 52 for elimination of vibration is interposed between center leg 301*c* and the I-shaped core 2; a thin insulator material 51 is sandwiched between each side leg 301*e* and the I-shaped core 2. After assembly of the E-shaped core 301, I-shaped core 2, insulator sheet 52 and insulator materials 51, a pair of permanent magnets 4*a,* for generating a magnetic flux Φm, are disposed on outer surfaces of the pair of magnetic gaps 5 formed between side legs 301*e* of E-shaped core 301 and I-shaped core 2. The permanent magnets 4*a* are magnetized to have opposing poles on each side of the EI-shaped core structure 310 identical in polarity while defining a neutral line Cm the magnets 4*a* of a given pair whereat the N pole and S pole are adjacent each other, and the neutral line Cm is aligned with the center line Cg of magnetic gaps 5. The pair of permanent magnets 4*a* and coil 3 may constitute a magnetic flux generation means. Provided on the back surfaces of permanent magnets 4*a* are plate-shaped back yokes 6 which consist of a pair of plates of magnetic materials.

The operation is as follows. When coil 3 is excited and magnetized by a pulsating D.C. current, the magnetic flux Φe formed by coil 3 extends from center leg 301*c* and follows along a magnetic path consisting of the I-shaped core 2, side legs 301*e* and the bottom portion of E-shaped core 301, as shown by solid lines in the drawing. On the other hand, the magnetic flux bias Φm created by each permanent magnet 4*a* extends from I-shaped core 2 and passes along a magnetic path as formed by center leg 301*c* a bottom portion of E-shaped core 301, one corresponding side leg 301*e* associated therewith, one adjacent permanent magnet 4*a* and an associated back yoke 6. More specifically, inside E-shaped core 301 and I-shaped core 2, magnetic flux Φe formed by the coil 3 and magnetic flux bias Φm created by permanent magnets 4*a* flow in opposite directions, while magnetic flux bias Φm created by permanent magnets 4*a* bypasses the magnetic flux Φe formed by coil 3 at the right and left magnetic gaps 5. Since the magnetic flux Φe formed by coil 3 does not penetrate the inside of permanent magnets 4*a,* permanent magnets 4*a* will not be demagnetized. Furthermore, because the magnetic flux bias Φm created by permanent magnets 4*a* and the magnetic flux Φe formed by the coil 3 are cancelled out with each other due to their reverse directions, any magnetic flux inside the core will decrease, enabling a smaller cross-sectional area of the core than would be possible were there no magnetic flux bias.

Figure 6:
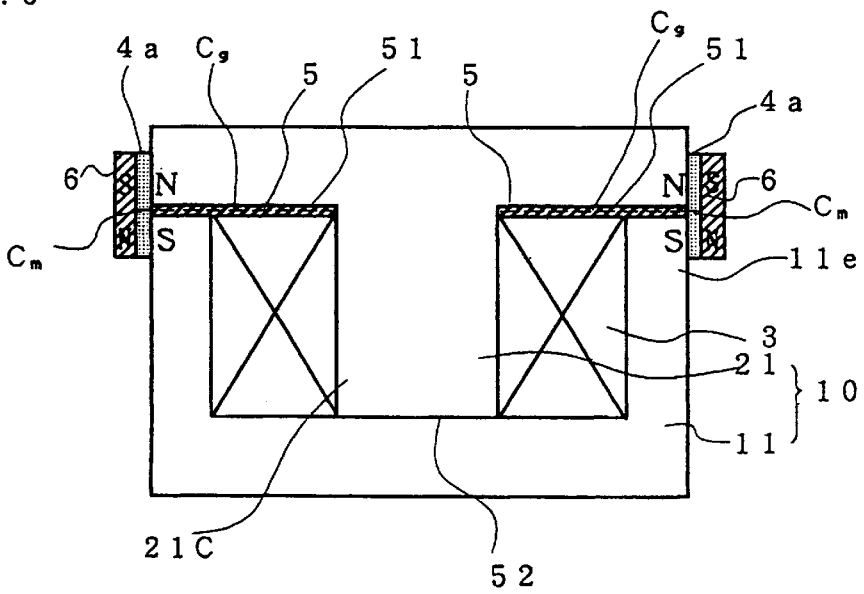
FIG. 6 is a diagram showing a principal cross-sectional view of a D.C. reactor in accordance with a sixth embodiment of the invention.

FIG. 6 is a diagram showing a principal cross-sectional view of a sixth embodiment of the invention. E-shaped core 301 of the fifth embodiment is replaced with a C-shaped core 411, while I-shaped core 2 thereof is replaced by a T-shaped core 421, thereby forming a CT-shaped core structure 410. A coil 3 is wound on a leg 421*c* of T-shaped core 421. A very thin insulator sheet 52 is interposed between the bottom portion of leg 421*c* of T-shaped core 421 and a top portion of a base portion of C-shaped core 411, whereas a thin insulator material 51 is sandwiched between each bottom portion 421*b* of T-shaped core 421 and a opposing side leg 411*e* of C-shaped core 411. A pair of permanent magnets 4*a* are provided on opposite outer surfaces of T-shaped core 421 and both legs 411*e* of C-shaped core 411, at which magnetic gaps 5 are defined, in such a manner that opposing ones of magnets 4*a* on opposite sides of the CT-shaped core structure 410 have the same polarity and that the neutral line Cm defined by the N pole and S pole on each side that are adjacent is aligned with the center line Cg of magnetic gaps 5. A pair of back yokes 6 made of a chosen magnetic material are adhered to the backs of permanent magnets 4*a,* respectively. The operation is similar to that of the fifth embodiment, and therefore an explanation thereof is omitted herein.

Figure 7:
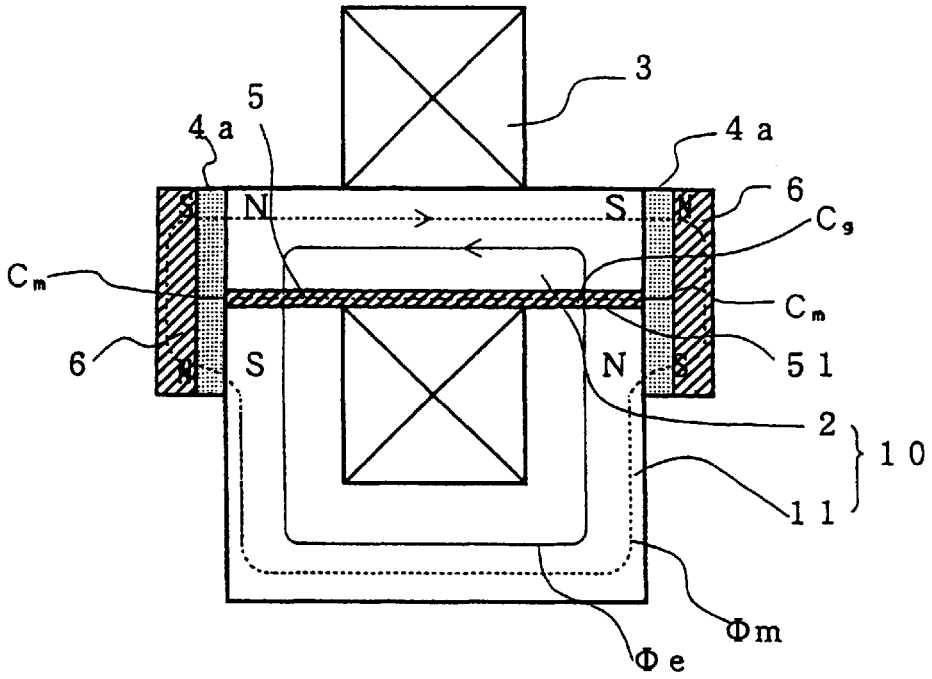
FIG. 7 is a diagram showing a principal cross-sectional view of a D.C. reactor in accordance with a seventh embodiment of the invention.

FIG. 7 is a diagram showing a principal cross-sectional view of a seventh embodiment of the invention. E-shaped core 301 of the fifth embodiment is replaced with a C-shaped core 511 to provide a CI-shaped core structure 510 as shown. A coil 3 is wound around the center section of I-shaped core 2. A pair of plate-shaped permanent magnets 4*a* for generating a magnetic flux bias are arranged on both outer surfaces of C-shaped core 511 and the I-shaped core 2 bridging magnetic gaps 5 therebetween. Opposed poles of the magnets 4*a* on opposite sides of the CI-shaped core structure 510 are of differing polarity and the neutral line Cm at which the N pole and S pole are adjacent is aligned with center line Cm of magnetic gaps 5. Permanent magnets 4*a* and coil 3 constitute a magnetic flux generation means. Back yokes 6 of a chosen magnetic material are provided on the back surfaces of permanent magnets 4*a* respectively. The operation thereof is as follows. When coil 3 is magnetized by a pulsating D.C. current fed thereto, the magnetic flux Φe formed by coil 3 flows through I-shaped core 2, magnetic gaps 5 and C-shaped core 511 as designated by the solid line in the drawing. The magnetic flux Φm created by each permanent magnet 4*a* flows inside I-shaped core 2 and C-shaped core 511 in a direction opposite that of the magnetic flux Φm as shown by the broken line in the drawing, in such a way that the magnetic flux Φm flows inside permanent magnets 4*a* and back yokes 6 at magnetic gaps 5 while actually bypassing magnetic gaps 5.

Figure 8:
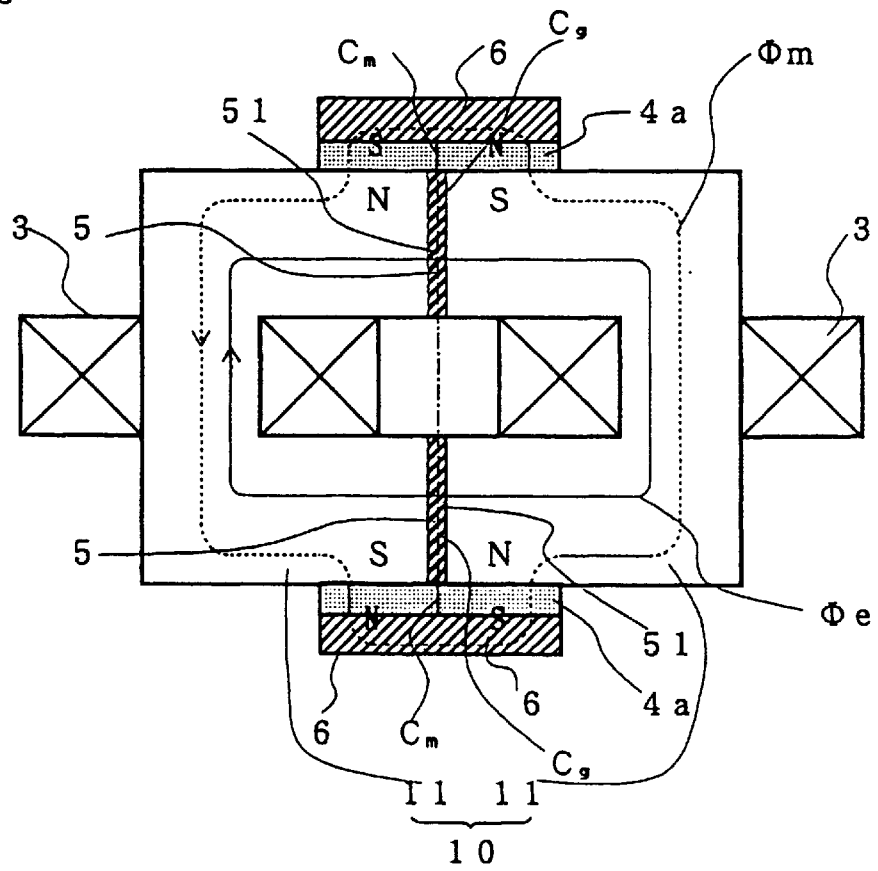
FIG. 8 is a diagram showing a principal cross-sectional view of a D.C. reactor in accordance with an eighth embodiment of the invention.

FIG. 8 is a diagram showing a principal cross-sectional view of an eighth embodiment of the invention. The I-shaped core 2 of the seventh embodiment is replaced with a C-shaped core 611 which opposes first C-shaped core 611 thus providing a pair of C-shaped cores that constitute a core structure 610. Each of these C-shaped cores 611 has a coil 3 wound thereon, forcing the magnetic flux formed by coil 3 to flow in the same direction. A pair of plate-shaped permanent magnets 4*a* for generating a magnetic flux bias are arranged on outer surfaces of both side legs 611*e* of C-shaped cores 611 bridging magnetic gaps 5 defined therebetween. Opposed poles of the magnets 4*a* on opposite sides of the core structure 610 are of different polarity and the neutral line Cm at which the N pole and S pole of permanent magnets 4*a* are adjacent each other is aligned with the center line Cg of magnetic gaps 5. A pair of back yokes 6 of a chosen magnetic material are provided on the back surfaces of permanent magnets 4*a*. With the arrangements as in the seventh and eighth embodiments, it becomes possible to render the magnetic gaps and the butt planes in a structurally common fashion, reducing the total number of butt planes.

Figure 9:
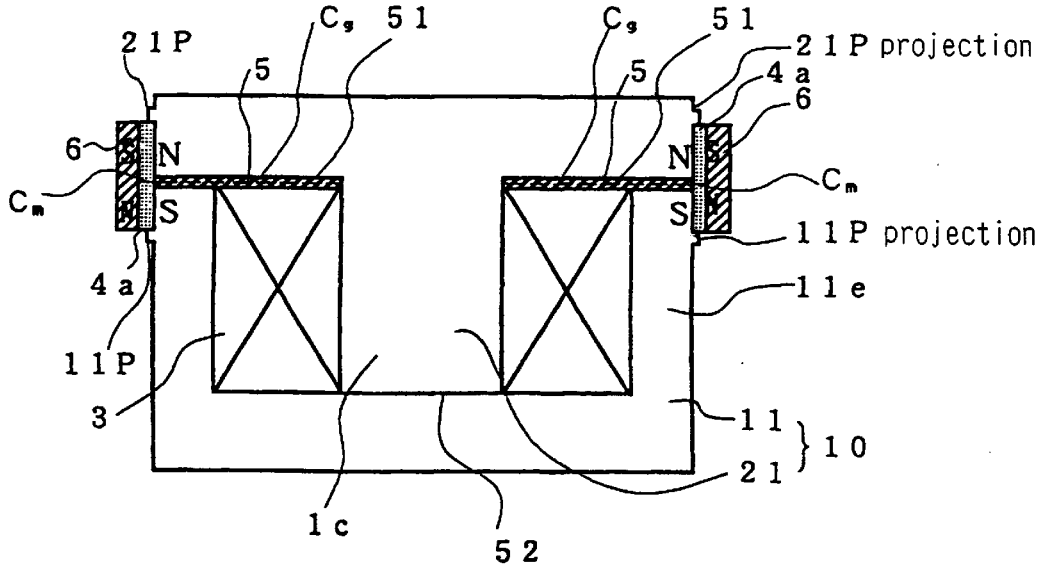
FIG. 9 is a diagram showing a principal cross-sectional view of a D.C. reactor in accordance with a ninth embodiment of the invention.

FIG. 9 is a diagram showing a principal cross-sectional view of a ninth embodiment of the invention.

This embodiment aims for the reliable position-determination/alignment of each core and permanent magnets of the fifth to eighth embodiments and also for easy attachment thereof. While the description here is directed to the sixth embodiment as an exemplary case, the same principles may also be applied to the remaining ones. Rectangular projections 21P are provided on both sides of T-shaped core 421. Likewise, rectangular projections 11P are formed on the both side surfaces of C-shaped core 411. The distance between the opposed surfaces of one projection 21P and its associated projection 11P is determined to ensure that neutral line Cm of permanent magnets 4*a* is aligned with the center line Cg of magnetic gaps 5 after T-shaped core 421 and C-shaped core 411 are assembled together. While individual permanent magnets 4*a* are set so that each is in contact with the upper surface of a corresponding projection 11P on one of the sides of C-shaped core 411, T-shaped core 421 is vertically inserted between permanent magnets 4*a* on both sides upward thereof causing neutral line Cm of permanent magnets 4*a* and center line Cg of magnetic gaps 5 to be set automatically. Note here that permanent magnets 4*a* employed in the fifth to ninth embodiments may alternatively be arranged so that each consists of two equally subdivided pieces in the longitudinal direction while allowing each piece to be disposed such that the longitudinally opposed portions thereof differ in polarity from each other.

As has been apparent from the above description, the D.C. reactors embodying the present invention are adaptable for use in inverter circuits.

We claim:

1. A D.C. reactor comprising:

a core structure having two opposing cores with magnetic gaps defined therebetween to form closed magnetic circuits across said magnetic gaps;

a coil on at least one of the two opposing cores of said core structure;

permanent magnet means, disposed on opposing sides of said core structure bridging sides of said magnetic gaps and having opposed portions of a same polarity, for inducing a biasing magnetic flux in said closed magnetic circuits which flows around said magnetic gaps; and said coil being wound in a direction to induce a magnetic flux in an opposite direction to that of the biasing magnetic flux throughout said core structure.

2. The D.C. reactor as recited in claim 1, wherein said two opposing cores are a T-shaped core and a C-shaped core.

3. The D.C. reactor as recited in claim 1, wherein said permanent magnet means each include first and second permanent magnets adjacent each other with poles thereof oppositely disposed, and a back yoke bridging said first and second permanent magnets with said first and second permanent magnets interposed between said back yoke and said core structure.

4. The D.C. reactor as recited in claim 1, wherein said permanent magnet means includes permanent magnets disposed with first poles, of common polarity, on opposing sides of one of said two opposing cores of said core structure, and back yoke bridges bridging second poles of said permanent magnets to opposing sides of another one of said two opposing cores.

5. The D.C. reactor as recited in claim 4, wherein said two opposing cores are a T-shaped core and a C-shaped core.

6. The D.C. reactor as recited in claim 1, wherein each of said permanent magnet means has first and second permanent magnets adjacent each other with poles thereof oppositely disposed.

7. A D.C. reactor comprising:

a core structure having first and second cores opposing each other with magnetic gaps defined therebetween to form a closed magnetic circuit across each of said magnetic gaps;

a coil on at least one of the first and second cores of said core structure;

permanent magnet means, disposed on sides of said core structure bridging sides of said magnetic gaps and having first poles of a same polarity applied to said first core and second poles, of opposite polarity from that of said first poles, applied to said second core, for inducing a biasing magnetic flux in said closed magnetic circuits which flows around said magnetic gaps; and said coil being wound in a direction to induce a magnetic flux in an opposite direction to that of the biasing magnetic flux throughout said core structure.

8. The D.C. reactor as recited in claim 7, wherein said first and second cores are a T-shaped core and a C-shaped core.

9. The D.C. reactor as recited in claim 7, wherein each of said permanent magnet means has first and second permanent magnets adjacent each other with poles thereof oppositely disposed.

10. The D.C. reactor as recited in claim 7, wherein said permanent magnet means includes permanent magnets disposed with said first poles applied to sides of said first core, and back yoke bridges bridging second poles of said permanent magnets to sides of said second core.

* * * * *